US008113908B1

(12) United States Patent
Modena et al.

(10) Patent No.: US 8,113,908 B1
(45) Date of Patent: Feb. 14, 2012

(54) STIFFENED BRASSIERE

(75) Inventors: Giovanna Modena, Brusaporto (IT); Federica Gambirasi, Lonigo (IT)

(73) Assignee: DBA Lux 1 Sarl, Luxemburg (LU)

( * ) Notice: Subject to any disclaimer, the term of this patent is extended or adjusted under 35 U.S.C. 154(b) by 785 days.

(21) Appl. No.: 10/333,290

(22) PCT Filed: Jul. 20, 2000

(86) PCT No.: PCT/IT00/00306

§ 371 (c)(1),
(2), (4) Date: Jun. 30, 2003

(87) PCT Pub. No.: WO02/07548

PCT Pub. Date: Jan. 31, 2002

(51) Int. Cl.
*A41C 3/00* (2006.01)

(52) U.S. Cl. ..... 450/39; 450/92; 450/93

(58) Field of Classification Search ..... 450/39, 450/40, 41, 45, 46, 47, 49, 51, 52, 92, 93, 450/57, 1; 2/243.1, 73, 78.1–78.4; 264/152–155, 264/157, 257, 258, 291, 292, 294, 320, 321, 264/163, 145, 148, 160; 156/245, 73.1, 73.3, 156/60, 72.4, 88
See application file for complete search history.

(56) References Cited

U.S. PATENT DOCUMENTS

| | | | | |
|---|---|---|---|---|
| 2,126,833 | A | | 8/1938 | Steinberger |
| 2,524,620 | A | | 1/1950 | Cadous |
| 2,524,621 | A | | 1/1950 | Cadous |
| 2,692,389 | A | | 10/1954 | Lamkin et al. |
| 2,915,067 | A | | 12/1959 | Bracht |
| 2,954,031 | A | | 9/1960 | Froehlich |
| 3,021,844 | A | * | 2/1962 | Flagg et al. ..... 450/39 |
| 3,064,329 | A | | 11/1962 | Westberg |
| 3,070,870 | A | | 1/1963 | Alexander et al. |
| 3,101,717 | A | | 8/1963 | Korman |
| 3,114,374 | A | | 12/1963 | Chalfin |
| 3,225,768 | A | | 12/1965 | Galitzki et al. |
| 3,266,495 | A | | 8/1966 | Sachs |
| 3,320,346 | A | | 5/1967 | Galitzki et al. |
| 3,327,707 | A | | 6/1967 | Storti |
| 3,383,263 | A | | 5/1968 | Storti |
| 3,497,415 | A | | 2/1970 | Adachi |
| 3,502,083 | A | | 3/1970 | Howard et al. |
| 3,725,954 | A | | 4/1973 | Baldini |
| 3,726,286 | A | | 4/1973 | Wolfson ..... 128/473 |
| 3,799,174 | A | | 3/1974 | Howard |
| 3,881,041 | A | | 4/1975 | Glienke |
| 3,939,023 | A | | 2/1976 | Magidson et al. |
| 3,947,207 | A | | 3/1976 | Magidson et al. |
| 3,998,231 | A | * | 12/1976 | Delet ..... 450/52 |
| 4,080,416 | A | | 3/1978 | Howard |
| 4,090,900 | A | | 5/1978 | Jacaruso et al. |
| 4,135,025 | A | | 1/1979 | Backes |

(Continued)

FOREIGN PATENT DOCUMENTS

| | | |
|---|---|---|
| CN | 1232652 | 4/1998 |

(Continued)

*Primary Examiner* — Gloria Hale
(74) *Attorney, Agent, or Firm* — Ohlandt, Greeley, Ruggiero & Perle, LLP

(57) ABSTRACT

A stiffened brassiere having two layers of fabric between which a stiffening element is inserted. The two layers of fabric are joined together by adhesive bonding and are then shaped to form the cups and the side bands of the brassiere.

28 Claims, 5 Drawing Sheets

U.S. PATENT DOCUMENTS

| | | | | | |
|---|---|---|---|---|---|
| 4,148,322 | A | | 4/1979 | Jacaruso et al. | |
| 4,172,002 | A | | 10/1979 | Gluckin | |
| 4,184,494 | A | | 1/1980 | King, Jr. | |
| 4,214,319 | A | | 7/1980 | Bollag | |
| 4,244,249 | A | | 1/1981 | DiTullio | |
| 4,248,923 | A | | 2/1981 | Ciobanu et al. | |
| 4,261,366 | A | | 4/1981 | Lamborn | |
| 4,372,321 | A | | 2/1983 | Robinson | |
| 4,375,445 | A | | 3/1983 | Cole et al. | |
| 4,419,997 | A | * | 12/1983 | Cole et al. | 450/65 |
| 4,481,951 | A | | 11/1984 | Cole et al. | |
| 4,557,267 | A | | 12/1985 | Cole | |
| 4,572,195 | A | | 2/1986 | Hyams | |
| 4,604,152 | A | | 8/1986 | Liukko | |
| 4,701,964 | A | | 10/1987 | Bell et al. | |
| 4,767,377 | A | | 8/1988 | Falla | |
| 4,776,916 | A | | 10/1988 | Prunesti et al. | |
| 4,795,400 | A | | 1/1989 | Greenberg | |
| 4,861,409 | A | | 8/1989 | Hashda et al. | |
| 4,895,751 | A | | 1/1990 | Kato et al. | |
| 4,957,466 | A | | 9/1990 | Hopps | |
| 5,092,812 | A | | 3/1992 | Babcock | |
| 5,154,659 | A | * | 10/1992 | Gluckin | 450/39 |
| 5,165,113 | A | | 11/1992 | Hyams et al. | |
| 5,240,538 | A | | 8/1993 | Hyams | |
| 5,359,732 | A | | 11/1994 | Waldman et al. | |
| 5,385,502 | A | | 1/1995 | Moretz et al. | |
| 5,406,646 | A | | 4/1995 | Balit et al. | |
| 5,426,791 | A | | 6/1995 | Sydor et al. | |
| 5,442,818 | A | | 8/1995 | Loos | |
| 5,447,462 | A | * | 9/1995 | Smith et al. | 450/122 |
| 5,479,791 | A | | 1/1996 | Osborne | |
| 5,487,189 | A | | 1/1996 | Bell | |
| 5,507,681 | A | | 4/1996 | Smith et al. | |
| 5,539,931 | A | | 7/1996 | Fizer et al. | |
| 5,553,468 | A | | 9/1996 | Osborne | |
| 5,590,548 | A | | 1/1997 | Osborne | |
| 5,592,836 | A | | 1/1997 | Schuster | |
| 5,605,060 | A | | 2/1997 | Osborne | |
| 5,611,722 | A | | 3/1997 | Osborne | |
| 5,614,303 | A | | 3/1997 | Baigas, Jr. | |
| 5,660,577 | A | * | 8/1997 | Modena | 450/86 |
| 5,787,512 | A | | 8/1998 | Knox | |
| 5,790,983 | A | | 8/1998 | Rosch et al. | |
| 5,814,003 | A | | 9/1998 | Knox | |
| 5,816,889 | A | | 10/1998 | Fildan | |
| 5,820,443 | A | | 10/1998 | Burr | 450/40 |
| 5,820,445 | A | | 10/1998 | Smith et al. | |
| 5,873,768 | A | | 2/1999 | Fleischman-Ament et al. | |
| 5,907,872 | A | | 6/1999 | Alberts et al. | |
| 5,916,829 | A | | 6/1999 | Girard et al. | |
| 5,938,500 | A | | 8/1999 | Hampton | |
| 5,946,944 | A | | 9/1999 | Osborne | |
| 5,953,754 | A | | 9/1999 | Rosch et al. | |
| 5,983,394 | A | | 11/1999 | Joo | |
| 5,984,762 | A | | 11/1999 | Tedeschi et al. | |
| 6,000,994 | A | | 12/1999 | Salotto | |
| 6,018,819 | A | | 2/2000 | King et al. | |
| 6,023,789 | A | | 2/2000 | Wilson et al. | |
| 6,048,253 | A | | 4/2000 | Larsen | |
| 6,076,186 | A | | 6/2000 | Grose | |
| 6,079,050 | A | | 6/2000 | Hooper-Jackson | |
| 6,083,080 | A | | 7/2000 | Lawson et al. | |
| 6,115,847 | A | | 9/2000 | Rosch et al. | |
| 6,125,664 | A | | 10/2000 | Browder | |
| 6,134,718 | A | | 10/2000 | Sesselmann | |
| 6,162,111 | A | | 12/2000 | Heroff | |
| 6,178,784 | B1 | | 1/2001 | Marley | |
| 6,179,687 | B1 | | 1/2001 | Lee et al. | |
| 6,192,521 | B1 | | 2/2001 | Alberts et al. | |
| 6,192,717 | B1 | | 2/2001 | Rabinowicz | |
| 6,287,168 | B1 | | 9/2001 | Rabinowicz | |
| 6,306,006 | B1 | | 10/2001 | Cheng | |
| 6,336,840 | B2 | | 1/2002 | Heroff | |
| 6,364,741 | B1 | | 4/2002 | Ferguson | |
| 6,398,620 | B1 | | 6/2002 | Huang | |
| 6,401,786 | B1 | | 6/2002 | Tedeschi et al. | |
| 6,425,800 | B1 | | 7/2002 | Huang | |
| 6,431,945 | B1 | | 8/2002 | Stephens et al. | |
| 6,431,947 | B1 | | 8/2002 | Henz | |
| 6,550,286 | B2 | * | 4/2003 | Querquant | 66/176 |
| 6,645,040 | B2 | * | 11/2003 | Rabinowicz et al. | 450/1 |
| 6,837,771 | B2 | * | 1/2005 | Falla | 450/39 |
| 2001/0000164 | A1 | | 4/2001 | Heroff | |
| 2002/0000684 | A1 | | 1/2002 | Nakanishi | |
| 2002/0002023 | A1 | | 1/2002 | Nakanishi | |
| 2002/0023709 | A1 | | 2/2002 | Tedeschi et al. | |
| 2002/0031978 | A1 | | 3/2002 | Heroff | |
| 2002/0111119 | A1 | | 8/2002 | Johnson et al. | |
| 2002/0155785 | A1 | | 10/2002 | del Olmo | |
| 2002/0155786 | A1 | | 10/2002 | Querquant | |
| 2003/0013379 | A1 | | 1/2003 | Henz | |
| 2003/0092355 | A1 | | 5/2003 | Rabinowicz | |

FOREIGN PATENT DOCUMENTS

| | | |
|---|---|---|
| DE | 298 10 765 | 10/1999 |
| DE | 200 11 261 | 2/2001 |
| DE | 199 42 996 | 3/2001 |
| EP | 0 604 812 | 12/1993 |
| EP | 734 660 | 10/1996 |
| EP | 0 852 915 | 7/1998 |
| EP | 875 612 | 11/1998 |
| EP | 1 033 084 | 9/2000 |
| EP | 1 123 666 | 8/2001 |
| FR | 1.362.777 | 4/1964 |
| FR | 1 362 777 | 9/1964 |
| FR | 2 487 734 | 2/1982 |
| FR | 1 282 812 | 2/1995 |
| FR | 2 782 611 | 3/2000 |
| FR | 2 785 154 | 5/2000 |
| FR | 2 792 173 | 10/2000 |
| FR | 2 820 001 | 8/2001 |
| FR | 2 823 075 | 10/2002 |
| GB | 1 237 196 | 6/1971 |
| GB | 1 348 132 | 3/1974 |
| GB | 1 470 928 | 4/1977 |
| GB | 2 265 077 | 9/1993 |
| IT | 01282812 | 7/1995 |
| JP | 9031856 | 2/1997 |
| JP | 2000226703 | 8/2000 |
| JP | 2000314011 | 11/2000 |
| JP | 2001073203 | 3/2001 |
| JP | 2002155403 | 4/2002 |
| JP | 2002201505 | 7/2002 |
| WO | WO 98/43503 | 10/1998 |
| WO | WO 01/85516 | 2/2001 |
| WO | WO 01/21019 | 3/2001 |
| WO | WO 02/07548 | 1/2002 |

* cited by examiner

STIFFENED BRASSIERE

FIELD OF THE INVENTION

The present invention relates to a stiffened brassiere.

BACKGROUND OF THE INVENTION

As is known, brassieres comprise two cups which are joined together, two side bands which extend out from the cups and are adapted to be fastened to one another, and two shoulder straps, each of which is attached at one end to one of the cups and at the other to the corresponding side band. Certain types of brassieres are strapless.

These brassieres are usually made from pieces of fabric which are stitched together in some suitable way to produce the abovementioned structure.

The stiffened brassiere has stiffening elements which are generally positioned along the bottom part of the cup so as to provide a high degree of support for the bust. These stiffening elements usually consist of two curved wires housed in tubular fabric casings which are sewn onto the inside of the brassiere.

In DE-U-29810765 such stitched stiffened brassiere is made using at least two superimposed layers of fabric between which the stiffening wires are inserted.

Unfortunately, stiffened brassieres are not very comfortable to wear.

This is because, in addition to the discomfort caused by the seams joining together the pieces of fabric which are also present in brassieres without underwiring or "soft" brassieres—there is the added discomfort of the underwires and their casings.

The seams joining together the pieces of fabric can be uncomfortable because they form irregularities on the brassiere's surface which can cause irritation when they come into contact with the skin, especially when you consider the relative movements that take place between the brassiere and the skin.

The underwires are even more uncomfortable precisely because they are rigid elements which press against the skin through the casings. Moreover, the fact that the casings with the underwires protrude wholly towards the inside of the brassiere just exacerbates the situation. The casing seams, like the other seams, constitute a further source of discomfort.

It should also be said that, over time, the seams are subject to wear and can therefore come undone, with the risk of the whole brassiere falling apart.

OBJECTS OF THE INVENTION

The object of the present invention is to provide a stiffened brassiere which is more comfortable than those of the prior art.

This object is achieved by means of a stiffened brassiere comprising two cups which are joined together, two side bands which extend out from the cups and can be fastened to one another, and stiffening wire which reinforce the structure of the brassiere, characterized in that it is made using at least two superimposed layers of fabric between which the stiffening wire are inserted, the two layers of fabric being joined together by means of adhesive bonding and being shaped so as to form the cups and the side bands.

BRIEF DESCRIPTION OF THE DRAWINGS

In order to gain a better understanding of the invention, a description is given below of a non-limiting exemplary embodiment thereof, which is illustrated in the appended drawings, in which.

DETAILED DESCRIPTION OF THE INVENTION

Figure 1:
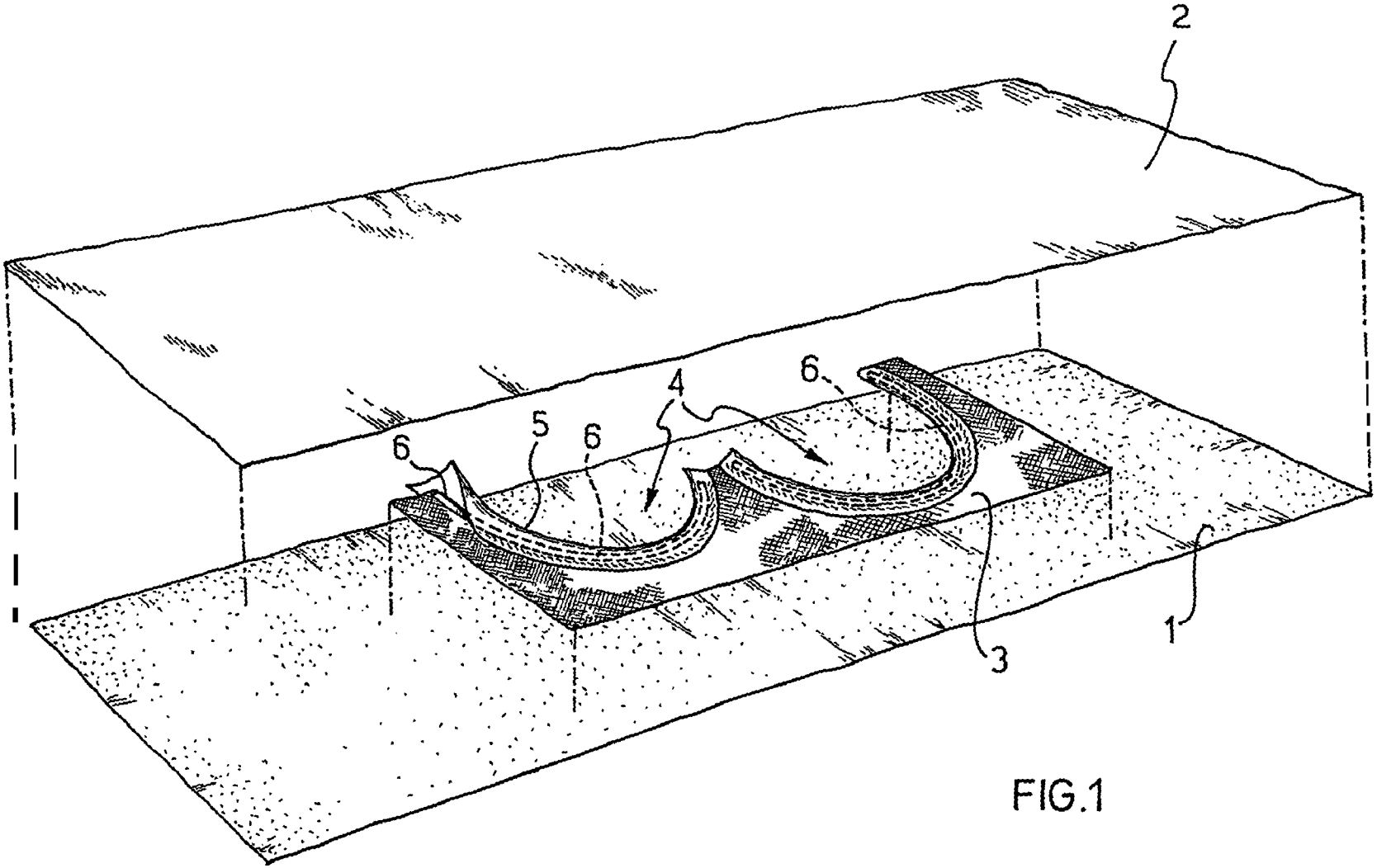
FIGS. 1, 2, 3, 4 show perspective views of the consecutive stages of production of a brassiere according to the invention.

With reference to FIG. 1, the latter shows an exploded view of some of the components of the brassiere according to the invention.

Two layers of fabric, namely a first layer of fabric 1 and a second layer of fabric 2 of the same shape and having a certain degree of elasticity, fitted to be superimposed, are provided.

A third layer of fabric 3 is also provided, which is smaller and less elastic than the first and second layers of fabric 1, 2. The third layer of fabric 3 has two adjacent curved edges 4 along which two corresponding curved tubular casings or fourth layer 5 are stitched. A corresponding curved wire 6 with a flattened cross section is inserted into each casing 5 and the ends of the casing are then sewn shut so as to enclose the wire in the casing.

Figure 2:
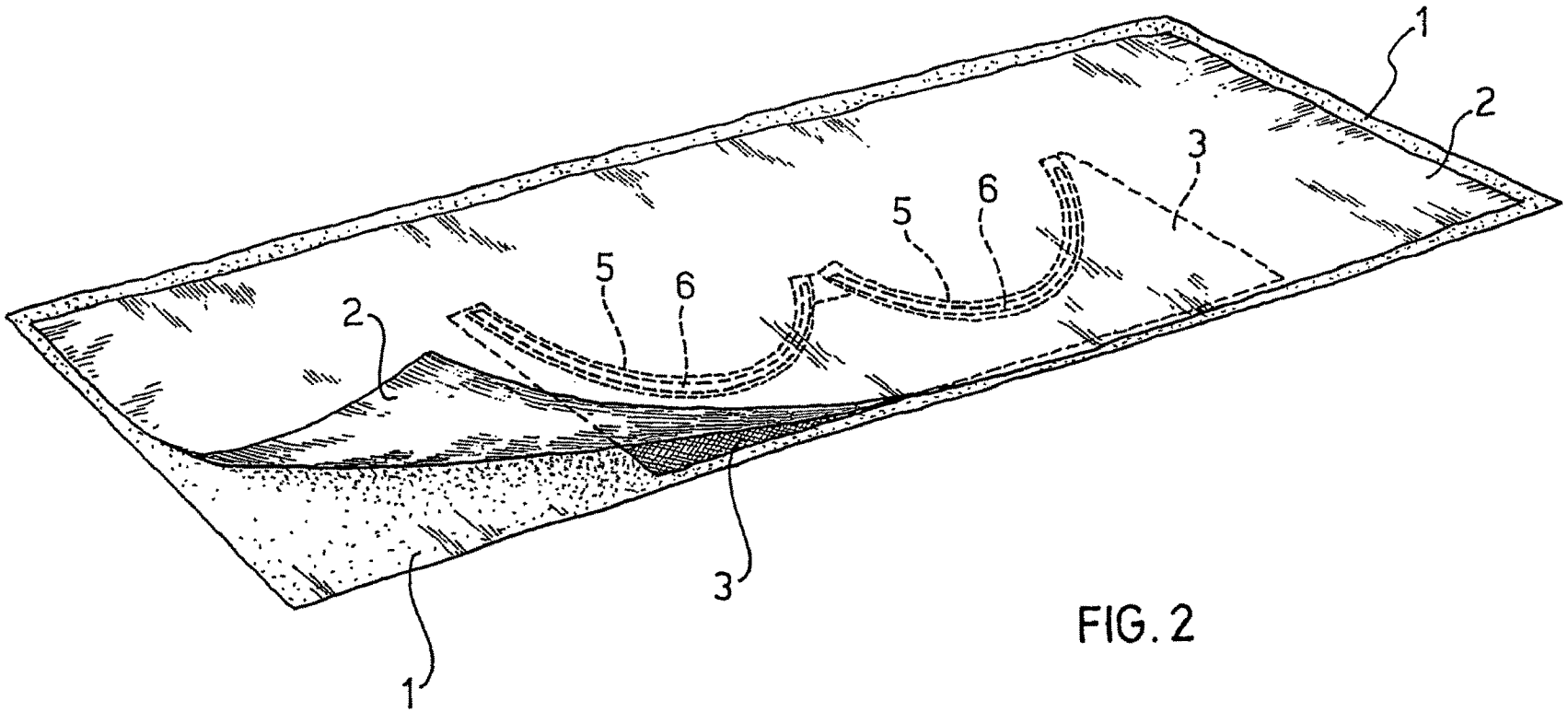

The first, second, and third layers of fabric 1, 2, 3 are placed one on top of the other and are joined together by means of adhesive bonding, inserting the third layer of fabric 3, with the casings 5 and the wires 6, between the first and second layers of fabric 1, 2 as shown in the sequence of FIGS. 1 and 2. This joining by means of adhesive bonding can involve gluing, for example using a thermoadhesive resin which is spread in a suitable manner onto the surfaces of the first, second, and third layers of fabric 1, 2, 3 which need to be joined together. The adhesively bonded joint can also, as long as suitable fabrics have been selected, be made by heatbonding or heat-fusing the fabric fibres, or by using other similar systems.

Figure 3:
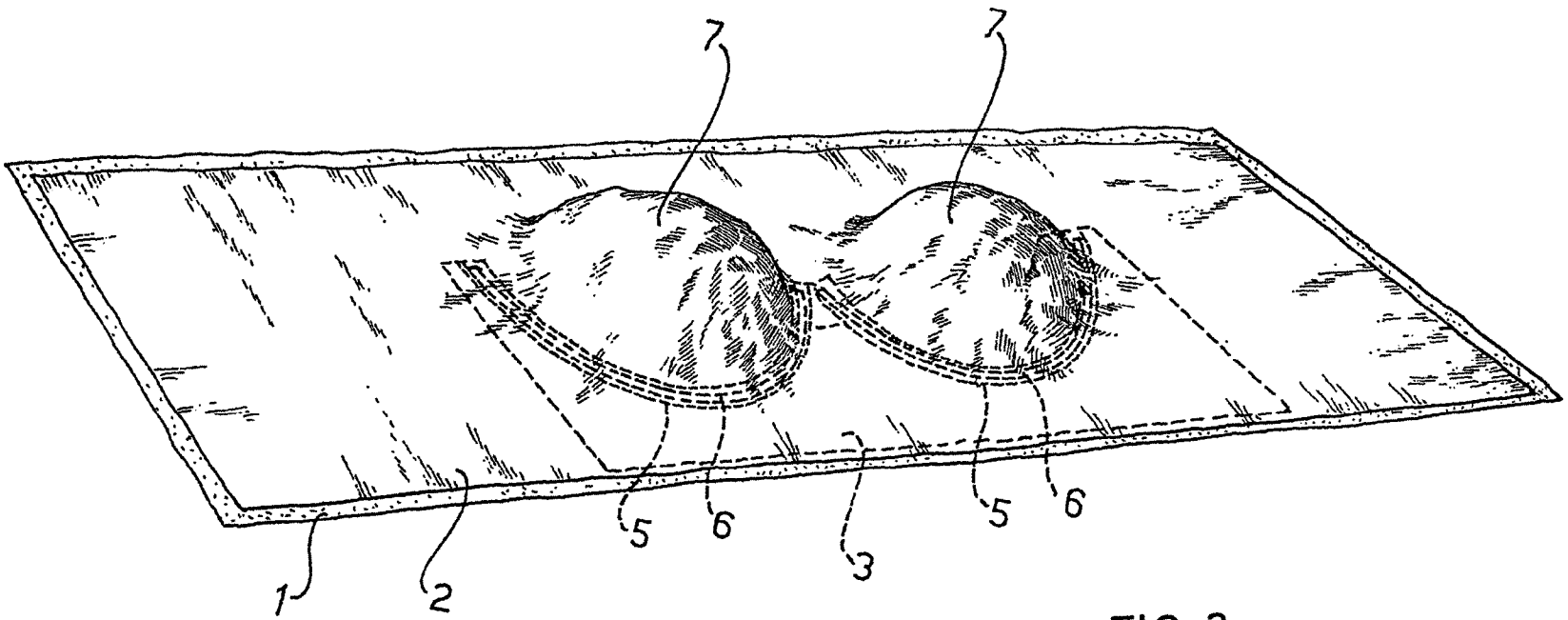

At this point, as shown in FIG. 3, the brassiere structure thus formed is pre-shaped using heat in order to produce two cups 7 in the region of the casings 5 containing the wires 6.

Figure 4:
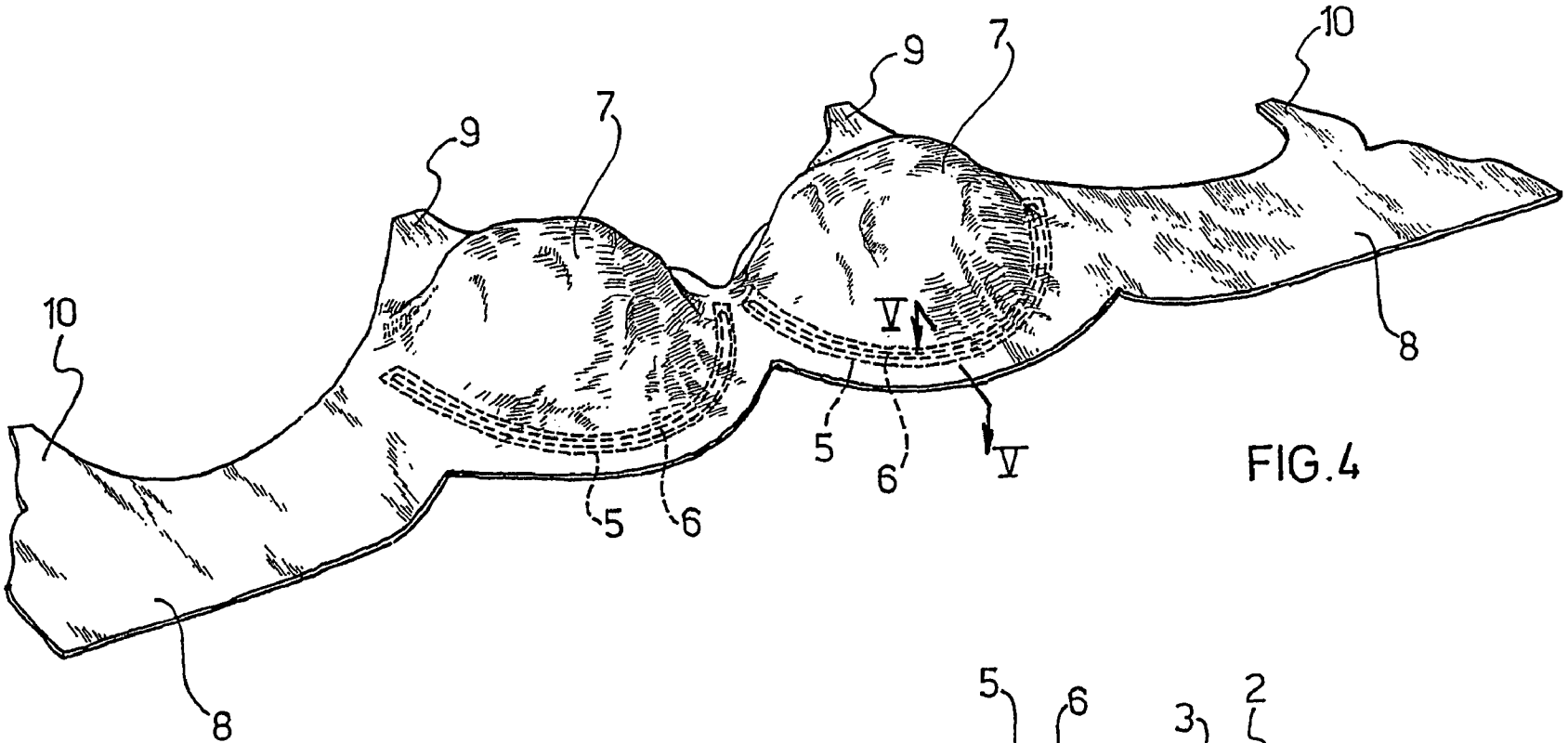

As may be seen in FIG. 4, the bra structure with the pre-shaped cups 7 is then cut out so as to produce the final brassiere shape with side bands 8 and with the areas around the cups 7 following the line of the cups themselves. These areas around the cups 7 extend to form two extension pieces 9 on the side opposite the side with the wires 6. Two extension pieces 10 also extend from the free ends of the side bands 8, on the same side as the extension pieces 9.

Figure 6:
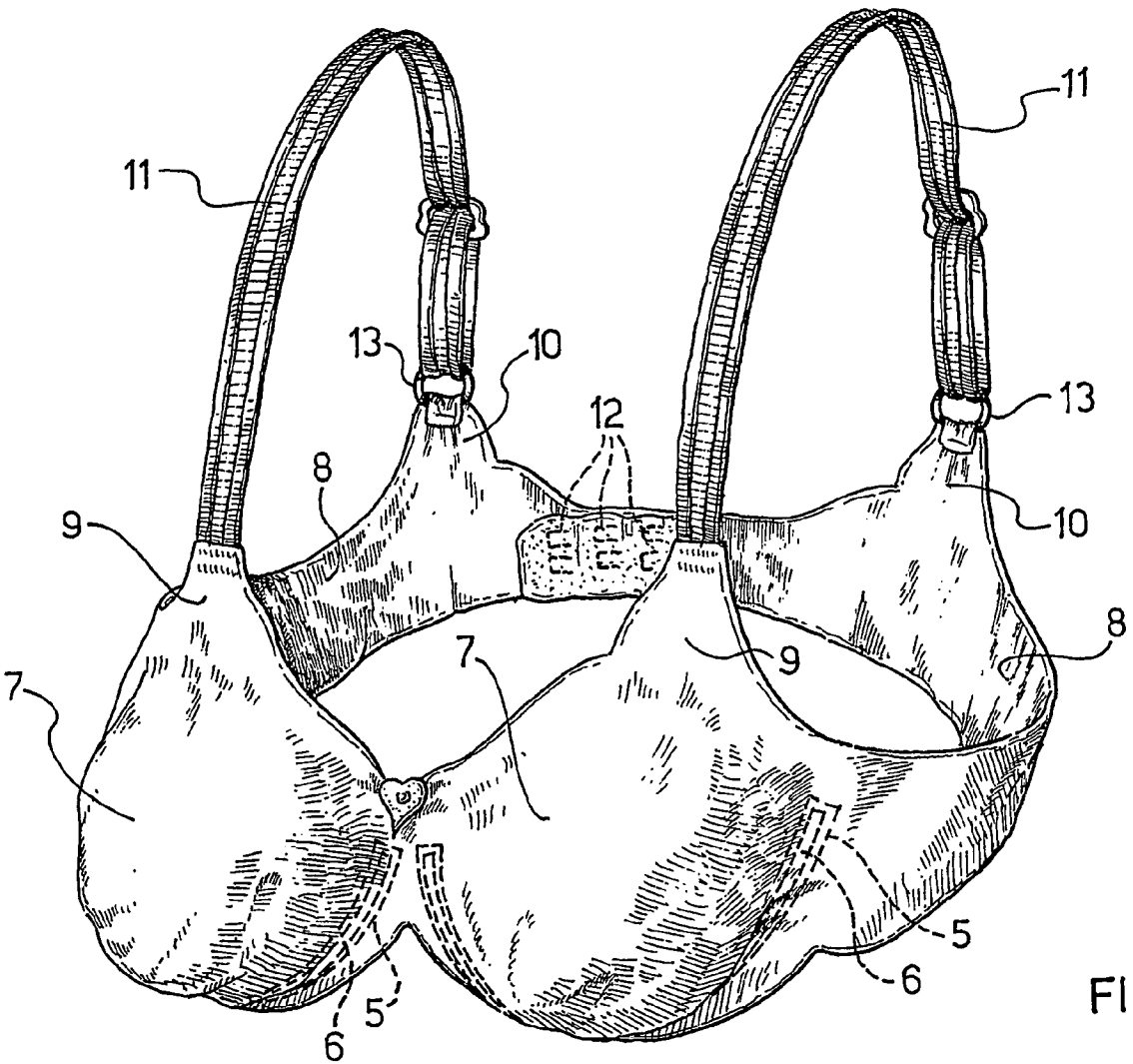
FIG. 6 shows the bra according to the invention in its final configuration.

The brassiere structure shown in FIG. 4 is completed by attaching shoulder straps to the extension pieces 9 and 10 and by applying fastening elements to the ends of the side bands 8 so as to give the finished brassiere shown in FIG. 6, where the shoulder straps are denoted by the reference 11 and the fastening elements by the reference 12. The shoulder straps 11 are attached to the extension pieces 10 by means of rings 13. The fastening elements consist of eyes attached to one of the two side bands 8 and of corresponding hooks attached to the other side band of the brassiere. The wires 6 are positioned along the bottom part of the cup so as to provide a high degree of support for the bust.

Although the brassiere in FIG. 6 is a stiffened brassiere since it is fitted with the wires 6, it is still comfortable.

First and foremost, there are no external seams and so irritation to the skin is avoided. The only seams present—those on the casings 5 containing the wires 6 are enclosed between the first and second layers of fabric 1, 2 and so do not come into contact with the skin.

Figure 5:
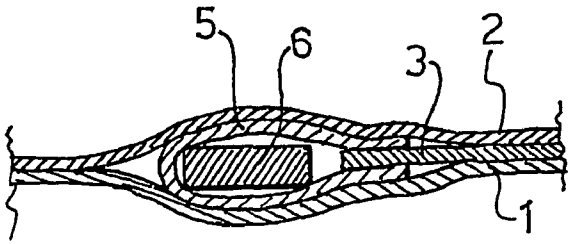
FIG. 5 is a cross section on the plane V-V of a detail of the brassiere structure shown in FIG. 4.

With reference to FIG. 5, the fact that the casings 5 containing the wires 6 are compressed between the first and second layers of fabric 1, 2 means that their thickness is reduced and, in addition, that they protrude towards the outside as well as towards the inside of the brassiere. All these features make the brassiere more comfortable than those, of the prior art as mentioned in the introduction, in which the casings containing the wires are not compressed and so protrude towards the inside.

The flattened shape of the wires 6 reduces the extent to which they protrude and so makes an appreciable contribution to increasing comfort.

The fact that the only seams—those of the casings 5 are enclosed between the first and second layers of fabric 1, 2 allows them to be protected against wear.

It should also be added that since the casings 5 are narrow and enclosed between the first and second layers of fabric 1, 2, they do not need to be secured to the third layer of fabric 3 by strong seams. Furthermore, the wires 6 are securely enclosed within the casings 5 and the two superimposed layers of fabric 1, 2, so that there is no way that they can come out.

In order to attach the shoulder straps 11 to the cups 7 and the fastening elements 12 to the side bands 8, seams can be made which, although external, are extremely unobtrusive. Alternatively, if it is desired not to use seams at all in these finishing operations, other attachment and closure systems—for example heat-bonding systems—can be used.

Thanks to the elasticity of the first and second layers of fabric 1, 2, there is no need to use elastic tape along the edges of the brassiere.

The brassiere of FIG. 6 is also very pleasing from the aesthetic viewpoint, given that there are no seams or elastic tapes; this gives the effect of the brassiere being in a single piece.

It is of course possible to make variations and/or additions to the embodiment described and illustrated.

It would be possible to do without the intermediate or third layer of fabric 3 and the casings 5 sewn to it, positioning the wires 6 directly between the first and second layers of fabric 1, 2. However, the solution illustrated is effective to assemble; moreover, the intermediate or third layer of fabric 3 reinforces the central part of the brassiere.

The wires can have a different cross section from the one illustrated, although a flattened cross section of the wires is, as seen above, advantageous.

The stiffening wires could consist of silicone material inserted into the casings.

In general the stiffening elements can be of any shape and size, they can vary in number and can be placed in any suitable position in the brassiere, depending on the various technical reinforcing requirements.

The general shape of the brassiere can be varied to meet different aesthetic and/or functional requirements. The brassiere can also be a strapless brassiere.

The present invention having been thus described with particular reference to the preferred forms thereof, it will be obvious that various modifications may be made therein without departing from the spirit and scope of the present invention as defined in the appended claims.

The invention claimed is:

1. A stiffened brassiere comprising:

a pair of cups, said pair of cups being joined together, a pair of side bands, said pair of side bands extending out from said pair of cups, and a pair of stiffening wires, said pair of stiffening wires being positioned between at least two superimposed layers of fabric, wherein said at least two superimposed layers of fabric are joined together by an adhesive so said pair of stiffening wires are between said at least two superimposed layers of fabric, wherein said at least two superimposed layers of fabric are cut to form said pair of cups and said pair of side bands so that said pair of cups and said pair of side bands are joined to one another without any external sewn seams; and wherein said at least two superimposed layers of fabric are shaped to form said pair of cups.

2. The brassiere according to claim 1, wherein said pair of stiffening wires are secured to a third layer of fabric inserted between said at least two superimposed layers of fabric.

3. The brassiere according to claim 2, wherein said pair of stiffening wires are housed in a pair of casings that are sewn onto said third layer of fabric.

4. The brassiere according to claim 3, wherein said third layer of fabric has two edges with each edge having an arc shape, said two edges being positioned along a bottom part of each of said pair of cups, and wherein said pair of casings are stitched along said bottom part of each of said pair of cups.

5. The brassiere according to claim 2, wherein said at least two superimposed layers of fabric are elastic.

6. The brassiere according to claim 5, wherein said third layer of fabric is less elastic than said at least two superimposed layers of fabric.

7. The brassiere according to claim 1, wherein each of said pair of stiffening wires is curved and positioned along said bottom part of each of said pair of cups.

8. The brassiere according to claim 1, wherein each of said pair of stiffening wires has a flattened cross section.

9. The brassiere according to claim 1, wherein each of said pair of stiffening wires comprises silicone material housed in a pair of casings to act as a stiffening element.

10. The brassiere according to claim 1, wherein said at least two superimposed layers of fabric are joined together by glue.

11. The brassiere according to claim 1, wherein said at least two superimposed layers of fabric are joined together by heat-bonding means.

12. The brassiere according to claim 1, further comprising a pair of shoulder straps, each of said pair of shoulder straps being connected at a first end to one of said pair of cups and at a second end to said corresponding one of said pair of side bands.

13. A process for manufacturing a brassiere comprising the steps of:

superimposing at least two layers of fabric;

inserting a pair of stiffening wires between said at least two layers of fabric;

joining said at least two layers of fabric together by an adhesive to secure said pair of stiffening wires inside said at least two layers of fabric;

shaping a pair of cups from said at least two layers of fabric;

cutting said at least two layers of fabric thereby forming a pair of side bands and shaping around said pair of cups so that said pair of side bands and said pair of cups are joined to one another without any external sewn seams; and connecting fastening elements to each of said pair of side bands.

14. The process according to claim 13, further comprising sewing a pair of casings onto a third layer of fabric, inserting said pair of stiffening wires into said pair of casings, and placing said third layer, pair of casings, and stiffening wires between said at least two layers of fabric prior to said step of superimposing said at least two layers of fabric.

15. The process according to claim 13, further comprising connecting a pair of shoulder straps to said pair of cups and to said pair of side bands.

16. The process according to claim 13, wherein said pair of cups are shaped by thermoforming.

17. A brassiere structure comprising:

a first layer;

a second layer being joined to said first layer by an adhesive so that said first and second layers define a laminate area having no external sewn seams, said laminate area having an outer periphery that is larger than a final brassiere shape having two side bands and two breast cups; and a stiffening element encased between said first and second layers within said outer periphery.

18. The brassiere structure of claim 17, further comprising a pair of breast cups defined in a region above said stiffening element.

19. The brassiere structure of claim 17, wherein said stiffening element comprises a third layer joined to a fourth layer by a sewn seam, said sewn seam being enclosed by said first and second layers.

20. The brassiere structure of claim 19, wherein said fourth layer is a wire casing, said wire casing being disposed about said stiffening element.

21. The brassiere structure of claim 19, wherein first and second layers prevent said sewn seam from contacting a wearer when the brassiere structure is worn.

22. The brassiere structure of claim 19, wherein said sewn seam is protected against wear by said first and second layers.

23. A stiffened brassiere comprising:

a first layer of seamless and elastic fabric;

a second layer of seamless and elastic fabric;

a third layer of elastic fabric, said third layer being smaller and less elastic than said first and second layers, said third layer having two adjacent curved edges;

an adhesive securing said first, second, and third layers together so that said third layer is completely between said first and second layers; and a pair of breast cups formed in said first and second layers.

24. The brassiere of claim 23, further comprising a curved tubular casing stitched to each of said two adjacent curved edges with a sewn seam.

25. The brassiere of claim 24, wherein said sewn seam is enclosed between said first and second layers.

26. The brassiere of claim 24, further comprising a curved wire enclosed in each of said curved tubular casings.

27. The brassiere of claim 26, wherein said curved wire comprises a flattened cross section.

28. The brassiere of claim 26, wherein said curved tubular casing and said curved wire are compressed between said first and second layers so that said curved tubular casing and said curved wire are positioned along a bottom part of said pair of breast cups.

* * * * *